US009822529B1

(12) United States Patent
Al-Salloum et al.

(10) Patent No.: US 9,822,529 B1
(45) Date of Patent: Nov. 21, 2017

(54) INTERLOCKING AND INSULATED CONSTRUCTION BLOCKS

(71) Applicant: KING SAUD UNIVERSITY, Riyadh (SA)

(72) Inventors: Yousef A. Al-Salloum, Riyadh (SA); Mohamed S. Morsy, Riyadh (SA); Tarek H. Almusallam, Riyadh (SA); Husain Abbas, Riyadh (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 15/345,984

(22) Filed: Nov. 8, 2016

(51) Int. Cl.
*E04C 1/41* (2006.01)

(52) U.S. Cl.
CPC ..... *E04C 1/41* (2013.01)

(58) Field of Classification Search
CPC ..... E04C 1/41
USPC ..... 52/596
See application file for complete search history.

(56) References Cited

U.S. PATENT DOCUMENTS 802,903 A * 10/1905 Anderson
1,384,080 A 7/1921 Merren
3,204,381 A * 9/1965 Perreton ..... E04B 2/46 52/309.12
3,936,987 A 2/1976 Calvin
3,998,022 A * 12/1976 Muse ..... E04B 2/44 52/564
4,123,881 A * 11/1978 Muse ..... E04B 2/44 52/100
4,134,241 A * 1/1979 Walton ..... E04L 32/16 52/275
4,184,166 A * 1/1980 Olson ..... G01D 3/02 346/114
4,498,266 A * 2/1985 Perreton ..... E04C 1/41 52/405.4
4,614,071 A * 9/1986 Sams ..... E04C 1/41 52/309.12
5,337,527 A 8/1994 Wagenaar
5,457,926 A 10/1995 Jensen
5,881,511 A * 3/1999 Keller, Jr. ..... E04L 32/08 52/220.2
6,134,853 A 10/2000 Haener
7,584,584 B2 9/2009 Fennell, Jr.
(Continued)

FOREIGN PATENT DOCUMENTS

DE 3216080 A1 * 11/1983 ..... E04C 1/41
WO WO 79/00198 A1 4/1979

*Primary Examiner* — Jeanette E Chapman
(74) *Attorney, Agent, or Firm* — Richard C. Litman

(57) ABSTRACT

An interlocking and insulated construction block includes a first pair of parallel, opposing sides and a second pair of parallel, opposing sides extending normal to the first pair of opposing sides. At least one cavity or recess extends through the construction block and includes a first volume of thermal insulation material. One or both sides of the first pair of opposing sides includes a pair of staggered engaging members or a pair of staggered receiving members configured to engage or lock with a mating pair of engaging members or receiving members of another insulated construction block. A plurality of different embodiments of the interlocking and insulated construction blocks may be provided in a set, and provide for mortar-less construction of walls due to their interlocking nature.

4 Claims, 12 Drawing Sheets

(56) References Cited

U.S. PATENT DOCUMENTS

| | | | | |
|---|---|---|---|---|
| 7,743,565 | B2 * | 6/2010 | Pyo | B28B 5/028 52/220.1 |
| D624,205 | S | 9/2010 | O'Connor | |
| D683,055 | S | 5/2013 | Nanayakkara | |
| D687,166 | S | 7/2013 | Dyson | |
| 8,915,039 | B1 * | 12/2014 | Oros | F16L 33/00 52/586.1 |
| 2005/0108972 | A1 * | 5/2005 | Banova | E04B 2/44 52/596 |
| 2006/0150559 | A1 | 7/2006 | Haener | |
| 2015/0159376 | A1 | 6/2015 | Biadora | |

* cited by examiner

INTERLOCKING AND INSULATED CONSTRUCTION BLOCKS

BACKGROUND OF THE INVENTION

1. Field of the Invention

The present invention relates to building construction and the like, and particularly to interlocking and insulated construction blocks for forming walls with a relatively high U-value.

2. Description of the Related Art

The "U-value" of a building element is the inverse of the total thermal resistance of that element. In other words, the U-value is a measure of how much heat is lost through a given thickness of a particular material. The efficiency desirability of insulated construction materials is generally measured by the U-value of the material. A common and relatively simple method for increasing the U-value of a wall is to affix a layer of insulation material thereto. In such common constructions, the insulated layer is then covered with a special type of render (i.e., plasterwork) or cladding, thus forming a two layer system; i.e., one insulating layer and a second outer layer for weather protection.

Another conventional construction method for further increasing the U-value involves using two leaves of hollow block wall, with the inner leaf of the block wall being relatively thicker. In such constructions, the two leaves of the wall are separated by a thermal insulation layer. The outer surface of the wall is protected against weather by plastering or affixing tiles. Thus one layer is for insulation, and a second outer layer is for weather protection. Typical insulation materials include expanded and/or extruded polystyrene, mineral wool, polyurethane foam and phenolic foam.

The thickness of the thermal insulation layer is determined based on the heat transmission characteristics of the different materials used in the construction of the wall and the U-value requirements of the region. The U-value requirements ultimately depend on the weather conditions of the region, which are typically measured in terms of the degree-days. The use of conventional two layer systems of the thermal protection is not only expensive, but also time consuming. Further, the attachment of the layers requires special care due to a high risk of frequent failure and detachment. Additionally, although conventional construction blocks of one wall thickness (typically on the order of 20 cm wide) are available with one layer of insulation, the insulation is usually not enough to meet the U-value requirements of extremely hot arid regions. Thus, interlocking and insulated construction blocks solving the aforementioned problems is desired.

SUMMARY OF THE INVENTION

An interlocking and insulated construction block includes a generally rectangular block at least one cavity or recess extending through the construction block. A volume of thermal insulation material is disposed in the at least one cavity. At least one side of the block includes a pair of staggered engaging members or a pair of staggered receiving members configured to engage or lock with a mating pair of engaging members or receiving members of another insulated construction block.

A plurality of different types of insulated masonry blocks may be provided in a set, and provide for mortar-less construction of walls due to their interlocking nature. The interlocking and insulated construction blocks may be used in the construction of external infill walls and the like. Some embodiments of the construction block includes two staggered cavities with thermally insulating material disposed therein. The staggering of the insulation-filled cavities provides the construction blocks with a U-value equal to, or less than, conventional construction elements which use a separate insulation layer. For example, the U-value of the present construction blocks can be about 0.39 $W/m^2K$.

A first type of interlocking and insulated construction block, which may serve as an intermediate block in wall construction or the like, includes first and second rectangular portions. Each of the first and second rectangular portions include a pair of longitudinally opposed walls and a pair of laterally opposed walls, and each portion further has open top and bottom ends and defines an open interior region. First and second volumes of thermal insulation material respectively fill the open interior regions of the first and second rectangular portions. The walls of the first and second rectangular portions may be formed from any suitable material, such as lightweight concrete, geopolymer or the like, and any suitable thermally insulating material may be used, such as expanded polystyrene, mineral wool, polyurethane foam, urethane foam, phenolic foam, cellulose, glass wool, rock wool, vermiculite, perlite, plant fibers, and combinations thereof.

The first and second rectangular portions are vertically aligned with respect to one another and are further longitudinally staggered with respect to one another. One of the laterally opposed walls of the first rectangular portion and one of the laterally opposed walls of the second rectangular portion define a central panel. The central panel has opposed top and bottom ends, with the top end thereof being vertically raised with respect to the open top ends of the first and second rectangular portions to define a vertical engaging member. Correspondingly, the bottom end thereof is vertically raised with respect to the open bottom ends of the first and second rectangular portions to define a vertical engaging recess.

Additionally, one of the longitudinally opposed walls of each of the first and second rectangular portions defines a horizontal engaging member, with a horizontal engaging recess being defined in the respective one of the first and second rectangular portions longitudinally opposite the corresponding horizontal engaging member. In use, two of the interlocking and insulated construction blocks may be interconnected by first horizontally aligning the blocks, and then locking the horizontal engaging members of one of the blocks into the corresponding horizontal engaging recesses of the other block. Similarly, two of the blocks may be vertically interconnected by first vertically aligning the blocks, and then vertically locking the vertical engaging member of one of the blocks into the corresponding vertical engaging recess of the other block.

A second type of block, which may serve as an end block, also includes first and second rectangular portions. Each of the first and second rectangular portions includes a pair of longitudinally opposed walls and a pair of laterally opposed walls, and each portion further has open top and bottom ends and defines an open interior region. First and second volumes of thermal insulation material respectively fill the open interior regions of the first and second rectangular portions. Unlike the first type of block, in which the first and second rectangular portions are longitudinally staggered, one of the longitudinally opposed walls of the first portion of the second type of block is horizontally aligned with a corresponding one of the longitudinally opposed walls of the second portion, thus forming a continuous planar end face.

Similar to the first type of block, each of the first and second rectangular portions of the second type of block are vertically aligned with respect to one another, but the first rectangular portion has a greater longitudinal length than a longitudinal length of the second rectangular portion. One of the laterally opposed walls of the first rectangular portion and one of the laterally opposed walls of the second rectangular portion define a central panel, with the central panel having opposed top and bottom ends. The top end thereof is vertically raised with respect to the top ends of the first and second rectangular portions to define a vertical engaging member, and the bottom end thereof is vertically raised with respect to the bottom ends of the first and second rectangular portions to define a vertical engaging recess. Further, one of the longitudinally opposed walls of each of the first and second rectangular portions defines a horizontal engaging member. In use, the second type of interlocking and insulated construction block may be interconnected horizontally with one of the first type of blocks by first horizontally aligning the blocks, and then locking the horizontal engaging members of the second type of block into the corresponding horizontal engaging recesses of the first type of block. Similarly, two of the second type of blocks may be vertically interconnected by first vertically aligning the blocks, and then vertically locking the vertical engaging member of one of the blocks into the corresponding vertical engaging recess of the other block. In an alternative embodiment, each horizontal engaging member of the first and second rectangular portions may be replaced by a horizontal engaging recess, thus allowing the second type of block to receive the horizontal engaging members of the first type of block.

A third type of block, which may also serve as an end block, also includes first and second rectangular portions. Each of the first and second rectangular portions includes a pair of longitudinally opposed walls and a pair of laterally opposed walls, and each portion further has top and bottom ends. Unlike the second type of block, the first rectangular portion of the third type of block solely has open top and bottom ends and defines an open interior region. The second rectangular portion is a solid and continuous piece of lightweight concrete, geopolymer or the like; i.e., a volume of thermal insulation material only fills the open interior region of the first rectangular portion.

Unlike the first type of block, and similar to the second type of block, one of the longitudinally opposed walls of the first portion of the second type of block is horizontally aligned with a corresponding one of the longitudinally opposed walls of the second portion, thus forming a continuous planar end face. Similar to the first and second types of block, each of the first and second rectangular portions of the third type of block are vertically aligned with respect to one another, but the first rectangular portion has a greater longitudinal length than a longitudinal length of the second rectangular portion. One of the laterally opposed walls of the first rectangular portion and one of the laterally opposed walls of the second rectangular portion define a central panel, with the central panel having opposed top and bottom ends. The top end thereof is vertically raised with respect to the top ends of the first and second rectangular portions to define a vertical engaging member, and the bottom end thereof is vertically raised with respect to the bottom ends of the first and second rectangular portions to define a vertical engaging recess. One of the longitudinally opposed walls of each of the first and second rectangular portions defines a horizontal engaging member.

In use, the third type of interlocking and insulated construction block may be interconnected horizontally with one of the first type of blocks by first horizontally aligning the blocks, and then locking the horizontal engaging members of the third type of block into the corresponding horizontal engaging recesses of the first type of block. Similarly, two of the third type of blocks may be vertically interconnected by first vertically aligning the blocks, and then vertically locking the vertical engaging member of one of the blocks into the corresponding vertical engaging recess of the other block. Alternatively, similar to the second type of blocks, each horizontal engaging member of the first and second rectangular portions may be replaced by a horizontal engaging recess, thus allowing the third type of block to receive the horizontal engaging members of the first type of block.

These and other features of the present invention will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

An insulated construction block can include a generally rectangular block having a first pair of parallel, opposing sides and a second pair of parallel, opposing sides extending normal to the first pair of opposing sides. At least one cavity or recess can extend through the construction block. A first volume of thermal insulation material can be disposed in at least one cavity. One or both sides of the first pair of opposing sides can include a pair of engaging members or a pair of receiving members configured to engage or lock with a mating pair of engaging members or receiving members of another insulated construction block. As described in more detail herein, the pair of engaging members can include a first tongue and a second tongue in staggered relation to each other. The receiving members can include a first groove and a second groove in staggered relation to each other.

Figure 1:
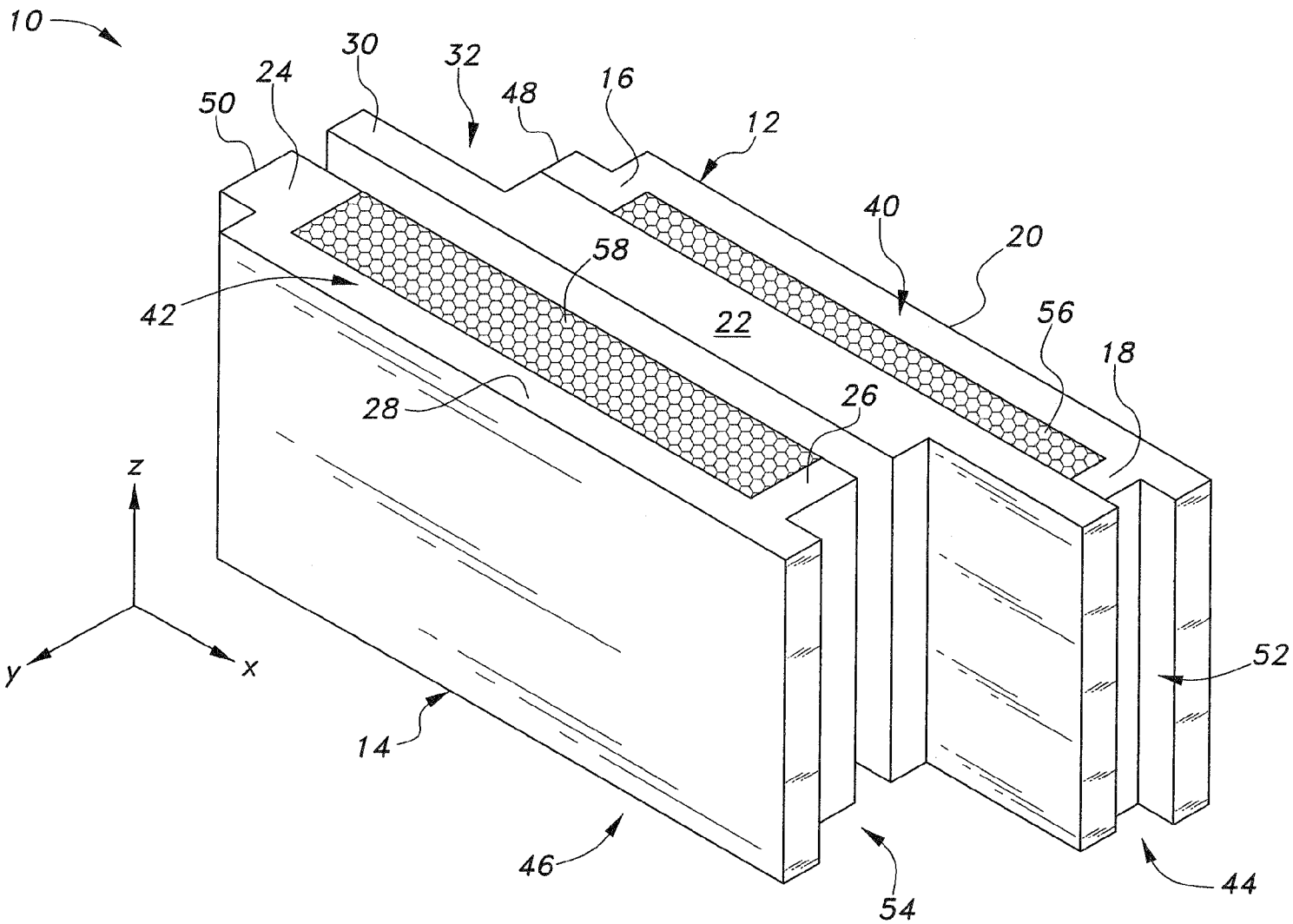
FIG. 1 is a perspective view of a first type of interlocking and insulated construction block according to the present invention.
Figure 2:
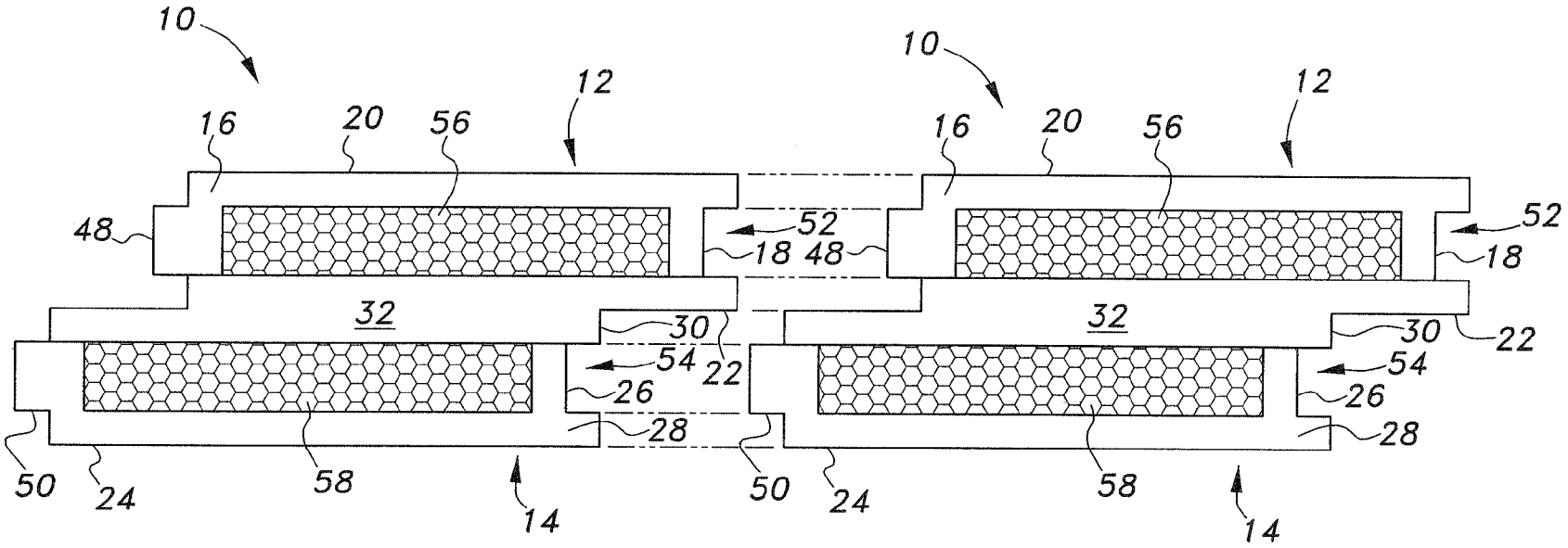
FIG. 2 is a top view of a pair of the first type of interlocking and insulated construction blocks of FIG. 1, illustrating horizontal interlocking therebetween.
Figure 3:
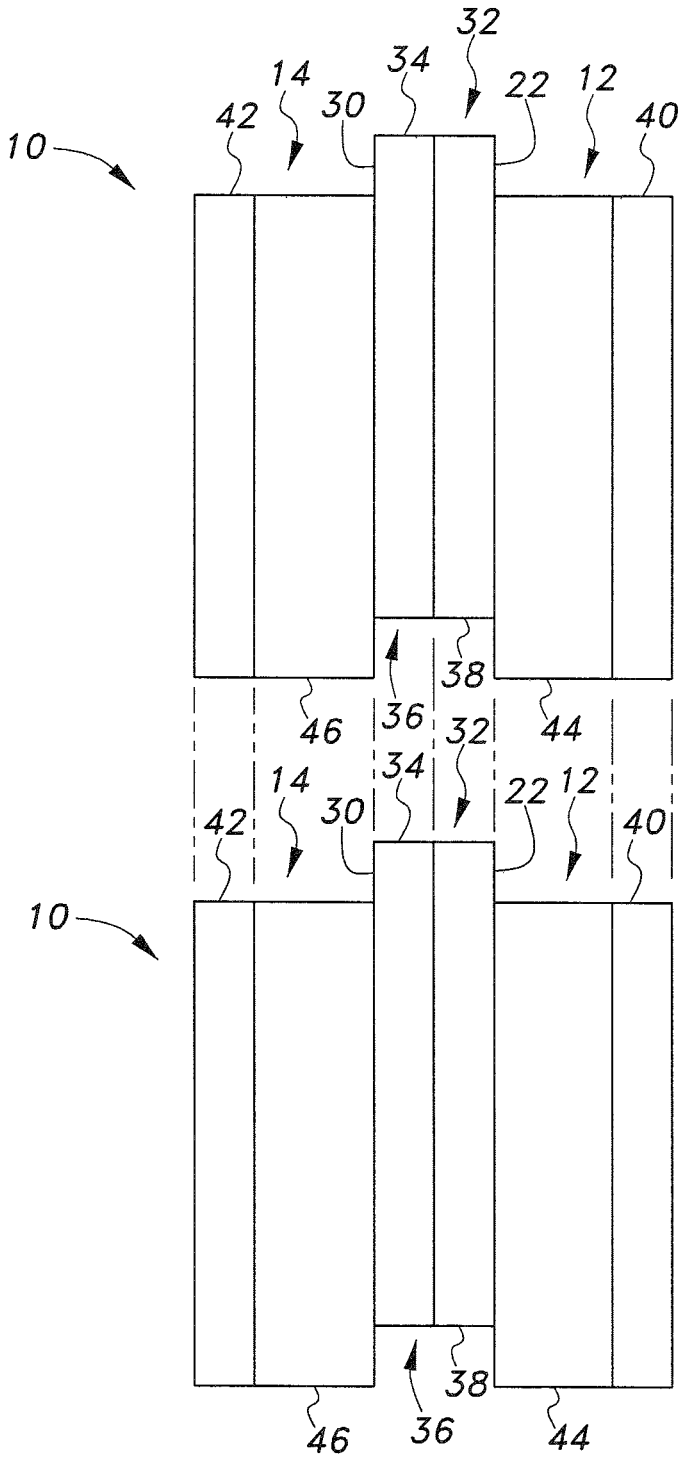
FIG. 3 is a side view of a pair of the first type of interlocking and insulated construction blocks of FIG. 1, illustrating vertical interlocking therebetween.

FIGS. 1-3 show a first embodiment of an interlocking and insulated construction block 10. The block 10 may serve as an intermediate block in wall construction or the like, and includes first and second rectangular portions 12, 14, respectively. The first rectangular portion 12 includes a pair of longitudinally opposed walls 16, 18 and a pair of laterally opposed walls 20, 22. The first rectangular portion 12 further has an open top end 40 and an open bottom end 44. In the orientation of FIG. 1, the longitudinal direction corresponds to the x-axis, the lateral direction corresponds to the y-axis, and the vertical direction corresponds to the z-axis. The walls 16, 18, 20, 22 of the first rectangular portion 12 define an open interior region therebetween. Similarly, the second rectangular portion 14 includes a pair of longitudinally opposed walls 24, 26 and a pair of laterally opposed walls 28, 30. The second rectangular portion 14 also has an open top end 42 and an open bottom end 46. The walls 24, 26, 28, 30 of the second rectangular portion 14 also define an open interior region therebetween.

First and second volumes of thermal insulation material 56, 58 respectively fill the open interior regions of the first and second rectangular portions 12, 14. The walls 16, 18, 20, 22, 24, 26, 28, 30 of the first and second rectangular portions 12, 14 may be formed from any suitable material, such as lightweight concrete, geopolymer or the like, and any suitable thermally insulating material may be used, such as expanded polystyrene, mineral wool, polyurethane foam, urethane foam, phenolic foam, cellulose, glass wool, rock wool, vermiculite, perlite, plant fibers, and combinations thereof.

The first and second rectangular portions 12, 14 are vertically aligned with respect to one another (i.e., the top ends 40, 42 are vertically aligned, as are the bottom ends 44, 46) and are further longitudinally staggered with respect to one another (as best shown in FIGS. 1 and 2). As best seen in FIG. 1, laterally opposed wall 22 of the first rectangular portion 12 and laterally opposed wall 30 of the second rectangular portion 14 define a central panel 32. As best shown in FIG. 3, the central panel 32 has opposed top and bottom ends, 34, 38, respectively, with the top end 34 being vertically raised with respect to the open top ends 40, 42 of the first and second rectangular portions 12, 14, respectively, to define a vertical tongue engaging member. Correspondingly, the bottom end 38 of panel 32 is vertically raised with respect to the open bottom ends 44, 46 of the first and second rectangular portions 12, 14, respectively, to define a vertical groove or engaging recess 36.

Additionally, as shown in FIGS. 1 and 2, longitudinally opposed walls 16, 24 of the first and second rectangular portions 12, 14, respectively, define horizontal tongues or engaging members 48, 50, respectively, with horizontal grooves or engaging recesses 52, 54 being defined in the first and second rectangular portions 12, 14. In use, as shown in FIG. 2, two of the interlocking and insulated construction blocks 10 may be interconnected by first horizontally aligning the blocks 10, and then locking the horizontal engaging members 48, 50 of one of the blocks 10 into the corresponding horizontal engaging recesses 52, 54 of the other block 10. Similarly, as shown in FIG. 3, two of the blocks 10 may be vertically interconnected by first vertically aligning the blocks 10, and then vertically locking the vertical engaging member 34 of one of the blocks 10 into the corresponding vertical engaging recess 36 of the other block 10.

It should be understood that blocks 10 may be manufactured in a wide variety of differing sizes and relative dimensions. However, exemplary dimensions for block 10 may include a longitudinal length of each outer, longitudinally extending wall (i.e., walls 20, 28 of FIG. 1) of 400 mm, a corresponding longitudinal length of walls 22, 30 of 400 mm, a longitudinal length of each horizontal engaging member (and depth of each horizontal engaging recess) of 25 mm, a longitudinal length of insulation of 325 mm, an individual wall thickness of 25 mm, a lateral length of insulation of 50 mm, and a lateral length of the central panel of 50 mm. The overall lateral length of block 10 in this example is 200 mm. The vertical height of each portion 12, 14 is 200 mm, and the height of the vertical engaging member 34 (and the corresponding depth of vertical engaging recess 36) is 25 mm. Assuming a density of expanded polystyrene as 30 kg/m$^3$ (used as an exemplary insulating material), the approximate weight of one such block 10 would be about 19.4 kg.

Figure 4:
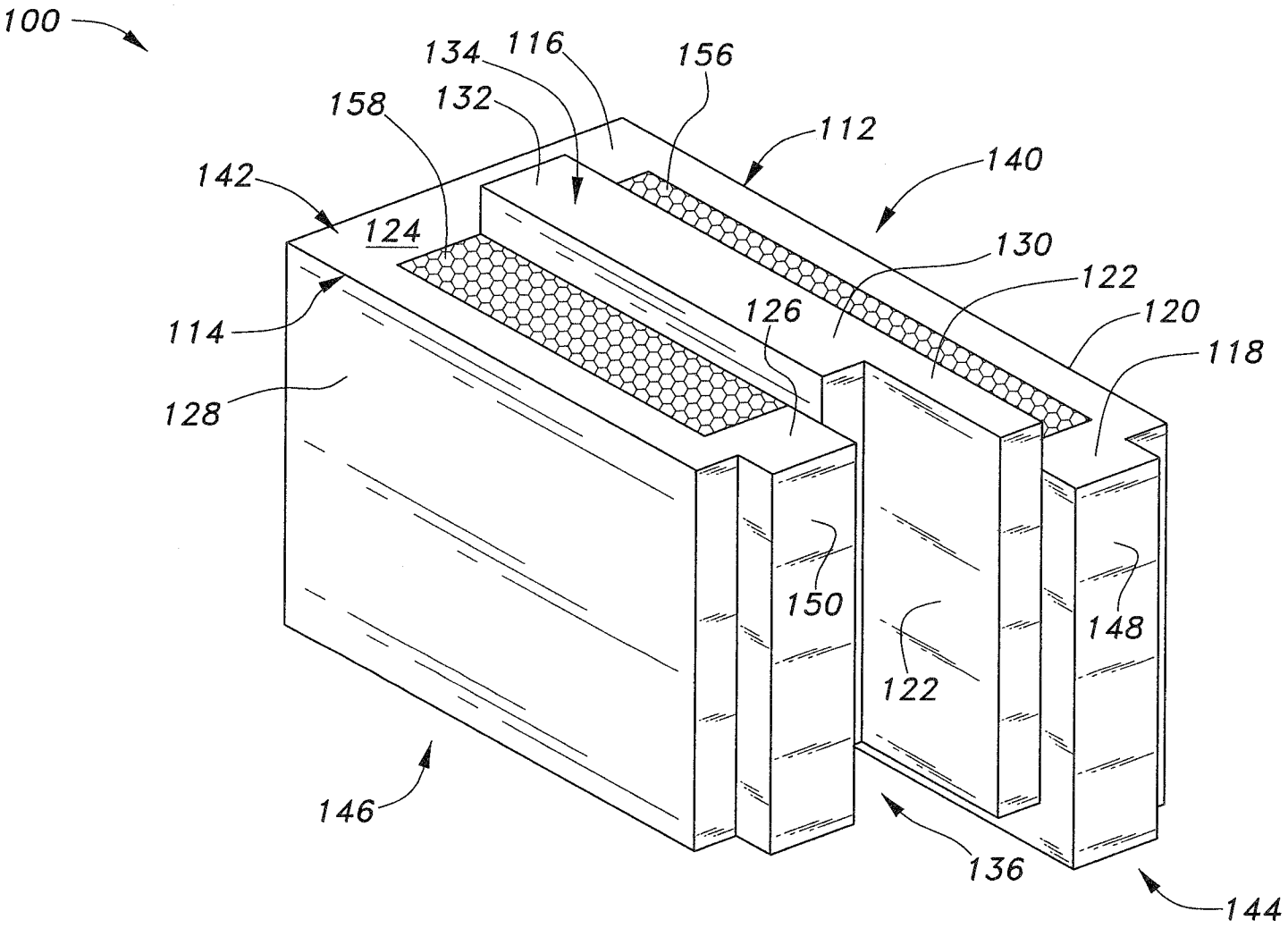
FIG. 4 is a perspective view of a second type of interlocking and insulated construction block according to the present invention.

A second type of block 100 is shown in FIG. 4. The second embodiment of block 100 may serve as an end block and, similar to the first embodiment of block 10, includes first and second rectangular portions 112, 114, respectively. The first rectangular portion 112 includes a pair of longitudinally opposed walls 116, 118 and a pair of laterally opposed walls 120, 122. The first rectangular portion 112 further has an open top end 140 and an open bottom end 144. The walls 116, 118, 120, 122 of the first rectangular portion 112 define an open interior region therebetween. Similarly, the second rectangular portion 114 includes a pair of longitudinally opposed walls 124, 126 and a pair of laterally opposed walls 128, 130. The second rectangular portion 114 also has an open top end 142 and an open bottom end 146. The walls 124, 126, 128, 130 of the second rectangular portion 114 also define an open interior region therebetween.

Similar to the first embodiment of block, first and second volumes of thermal insulation material 156, 158 respectively fill the open interior regions of the first and second rectangular portions 112, 114. The walls 116, 118, 120, 122, 124, 126, 128, 130 of the first and second rectangular portions 112, 114 may be formed from any suitable material, such as lightweight concrete, geopolymer or the like, and any suitable thermally insulating material may be used, such as expanded polystyrene, mineral wool, polyurethane foam, urethane foam, phenolic foam, cellulose, glass wool, rock wool, vermiculite, perlite, plant fibers, and combinations thereof.

Unlike the first embodiment of block 10, in which the first and second rectangular portions 12, 14 are longitudinally staggered, one of the longitudinally opposed walls 116 of the first portion 112 of the second embodiment of block 100 is horizontally aligned with a corresponding one of the longitudinally opposed walls 124 of the second portion, thus forming a continuous planar end face, allowing the second embodiment of block 100 to be used as an end block in construction. Similar to the first embodiment of block 10, each of the first and second rectangular portions 112, 114 of the second embodiment of block 100 are vertically aligned with respect to one another (i.e., the top ends 140, 142 are vertically aligned, as are the bottom ends 144, 146), but the first rectangular portion 112 has a greater longitudinal length than a longitudinal length of the second rectangular portion 114, as can be seen in FIG. 4.

As shown in FIG. 4, laterally opposed wall 122 of the first rectangular portion 112 and laterally opposed wall 130 of the second rectangular portion 114 define a central panel 132. Similar to panel 32 of the first embodiment of block 10, central panel 132 has opposed top and bottom ends, with the top end 134 being vertically raised with respect to the open top ends 140, 142 of the first and second rectangular portions 112, 114, respectively, to define a vertical tongue or engaging member. Correspondingly, the bottom end of panel 132 is vertically raised with respect to the open bottom ends 144, 146 of the first and second rectangular portions 112, 114, respectively, to define a vertical groove or engaging recess 136.

Additionally, as shown in FIG. 4, the first and second rectangular portions 112, 114 include horizontal engaging members 148, 150, respectively. In use, the second embodiment of interlocking and insulated construction block 100 may be interconnected horizontally with one of the first embodiment of blocks 10 by first horizontally aligning the blocks 10, 100, and then locking the horizontal engaging members 148, 150 of the second embodiment of block 100 into the corresponding horizontal engaging recesses 52, 54 of the first embodiment of block 10 (similar to the interlocking shown in FIG. 2 for the two blocks 10). Similarly, two of the second embodiment of blocks 100 may be vertically interconnected by first vertically aligning the blocks 100, and then vertically locking the vertical engaging member 134 of one of the blocks 100 into the corresponding vertical engaging recess 136 of the other block 100 (similar to the interlocking shown in FIG. 3 for the two blocks 10).

It should be understood that blocks 100 may be manufactured in a wide variety of differing sizes and relative dimensions. However, exemplary dimensions for block 100 may include a longitudinal length of wall 120 of 400 mm, a longitudinal length of wall 128 of 300 mm, a longitudinal length of wall 122 of 350 mm, a longitudinal length of wall 130 of 250 mm, a longitudinal length of each horizontal engaging member of 25 mm, a longitudinal length of insulation material 156 of 300 mm, a longitudinal length of insulation material 158 of 200 mm, an individual wall thickness of 25 mm with a double thickness (i.e., 50 mm) for the continuous wall formed by wall 116 and wall 124, a lateral length of insulation of 50 mm, and a lateral length of the central panel of 50 mm. The overall lateral length of block 100 in this example is 200 mm. The vertical height of each portion 112, 114 is 200 mm, and the height of the vertical engaging member 134 (and the corresponding depth of vertical engaging recess 136) is 25 mm. The weight of full-size end block 100 would be slightly less than that of the intermediate block 10.

Figure 5:
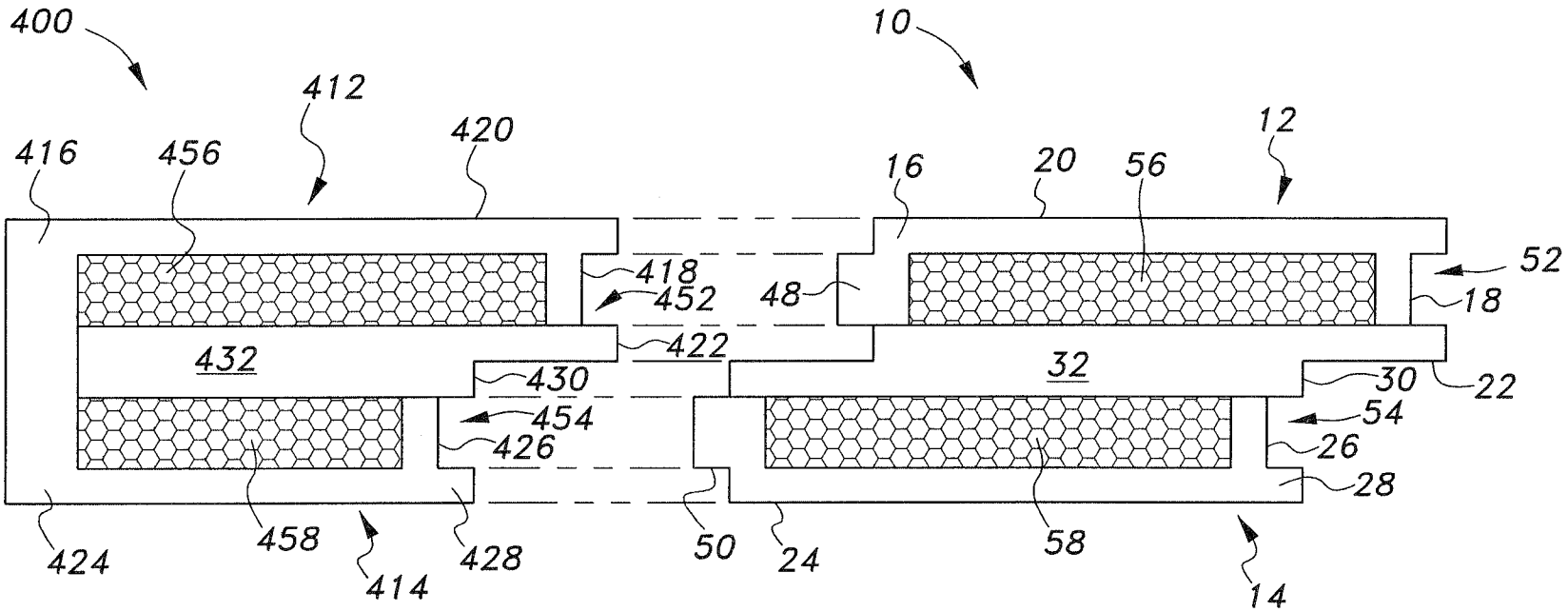
FIG. 5 is a top view of the first type of interlocking and insulated construction block of FIG. 1 and the alternative embodiment of the interlocking and insulated construction block of FIG. 4, illustrating horizontal interlocking therebetween.

In the alternative embodiment of FIG. 5, interlocking and insulated construction block 400 is identical to interlocking and insulated construction block 100, but each horizontal engaging member 148, 150 of the first and second rectangular portions 112, 114, respectively, of the second embodiment of block 100 is replaced by a horizontal engaging recess, thus allowing the block 400 to receive the horizontal engaging members 48, 50 of the first embodiment of block 10. Briefly, as shown in FIG. 5, block 400 includes first and second rectangular portions 412, 414, respectively. The first rectangular portion 412 includes a pair of longitudinally opposed walls 416, 418 and a pair of laterally opposed walls 420, 422. The walls 416, 418, 420, 422 of the first rectangular portion 412 define an open interior region therebetween. Similarly, the second rectangular portion 414 includes a pair of longitudinally opposed walls 424, 426 and a pair of laterally opposed walls 428, 430. The walls 424, 426, 428, 430 of the second rectangular portion 414 also define an open interior region therebetween. Similar to the first and second embodiments of the blocks, first and second volumes of thermal insulation material 456, 458 respectively fill the open interior regions of the first and second rectangular portions 412, 414.

FIG. 5 illustrates the interlocking and insulated construction block 400 being horizontally connected with block 10 of the first embodiment. Here, the two blocks 10, 400 are first horizontally aligned, and then the horizontal engaging members 48, 50 of block 10 are locked into the corresponding horizontal engaging recesses 452, 454 of block 400.

Figure 6A:
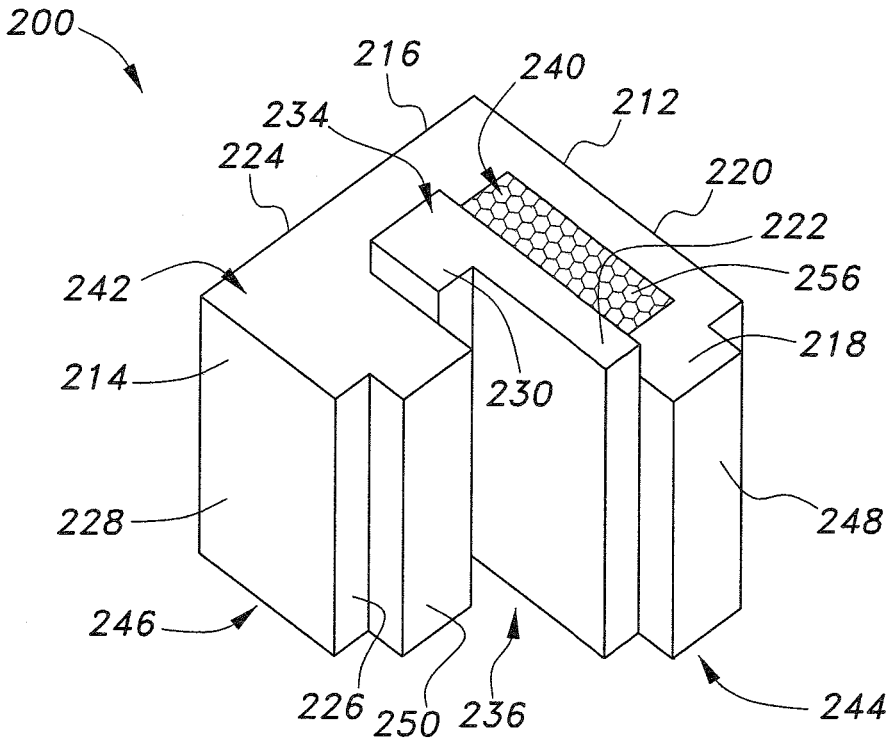
FIG. 6A is a perspective view of a third type of interlocking and insulated construction block according to the present invention.
Figure 6B:
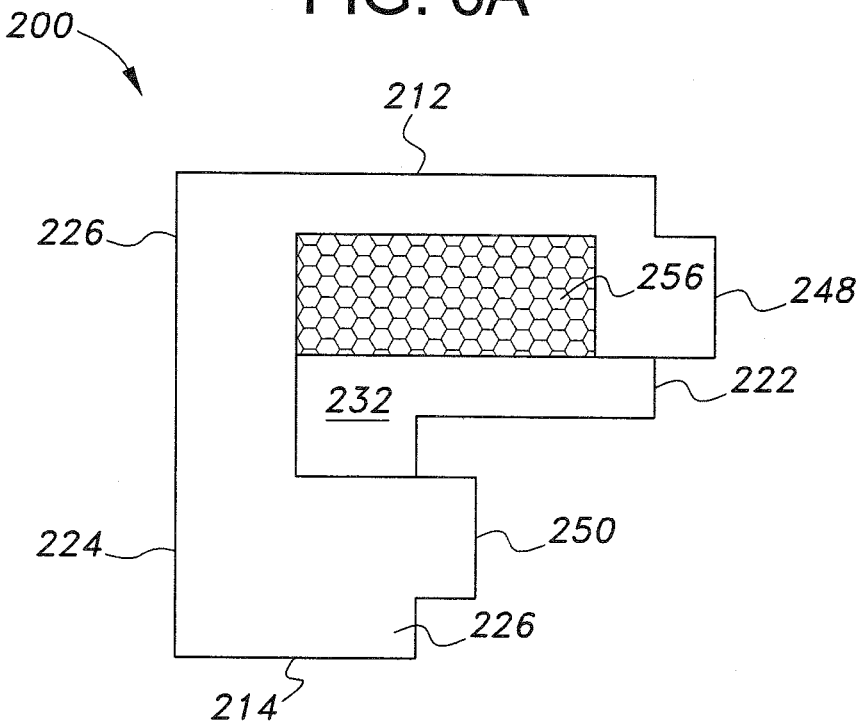
FIG. 6B is a top view of the third type of interlocking and insulated construction block of FIG. 6A.

A third embodiment of block 200 is shown in FIGS. 6A and 6B. The third embodiment of block 200 may serve as a half-size end block and, similar to the first and second embodiments of blocks 10, 100, includes first and second rectangular portions 212, 214, respectively. The first rectangular portion 212 includes a pair of longitudinally opposed walls 216, 218 and a pair of laterally opposed walls 220, 222. The first rectangular portion 212 further has an open top end 240 and an open bottom end 244. The walls 216, 218, 220, 222 of the first rectangular portion 212 define an open interior region. Unlike the second embodiment of block 100, only the first rectangular portion 212 of the third embodiment of block 200 has open top and bottom ends and defines an open interior region.

The second rectangular portion 214 is also defined by a pair of longitudinally opposed walls 224, 226 and a pair of laterally opposed walls 228, 230. However, the second rectangular portion 214 is a solid piece, e.g., a solid and continuous piece of lightweight concrete, geopolymer or the like. In block 200, the volume of thermal insulation material only fills the first rectangular portion 212, not the second rectangular portion. Thus, the second rectangular portion 214 has closed, or continuous, top and bottom ends 242, 246, respectively.

Unlike the first embodiment of block 10, and similar to the second embodiment of block 100, one of the longitudinally opposed walls 216 of the first portion 212 of the third embodiment of block 200 is horizontally aligned with a corresponding one of the longitudinally opposed walls 224 of the second portion 214, thus forming a continuous planar end face, allowing the third embodiment of block 200 to be used as a half-size end block in construction. Similar to the first embodiment of block 10, each of the first and second rectangular portions 212, 214 of the third embodiment of block 200 are vertically aligned with respect to one another (i.e., the top ends 240, 242 are vertically aligned, as are the bottom ends 244, 246), but the first rectangular portion 212 has a greater longitudinal length than a longitudinal length of the second rectangular portion 214, as can be seen in FIGS. 6A and 6B.

As shown in FIG. 6A, laterally opposed wall 222 of the first rectangular portion 212 and laterally opposed wall 230 of the second rectangular portion 214 define a central panel 232. Similar to panel 32 of the first embodiment of block 10, central panel 232 has opposed top and bottom ends, with the top end 234 being vertically raised with respect to the top ends 240, 242 of the first and second rectangular portions 212, 214, respectively, to define a vertical engaging member. Correspondingly, the bottom end of panel 232 is vertically raised with respect to the bottom ends 244, 246 of the first and second rectangular portions 212, 214, respectively, to define a vertical engaging recess 236.

Additionally, as shown in FIGS. 6A and 6B, longitudinally opposed walls 218, 226 of the first and second rectangular portions 212, 214, respectively, define horizontal engaging members 248, 250, respectively. In use, the third embodiment of interlocking and insulated construction block 200 may be interconnected horizontally with one of the first embodiment of blocks 10 in a manner similar to that described above with regard to the previous embodiments. Similarly, two of the third embodiment of blocks 100 may be vertically interconnected in a manner similar to that described above. Further, it should be understood that similar to the second embodiment of interlock and insulated construction block 200, as described above, each horizontal engaging member 248, 250 of the first and second rectangular portions 212, 214, respectively, of the second embodiment of block 200 may be replaced by a horizontal engaging recess, thus allowing the block 200 to receive the horizontal engaging members 48, 50 of the first embodiment of block 10.

It should be understood that blocks 200 may be manufactured in a wide variety of differing sizes and relative dimensions. However, exemplary dimensions for block 200 may include a longitudinal length of wall 220 of 200 mm, a longitudinal length of wall 228 of 100 mm, a longitudinal length of wall 222 of 150 mm, a longitudinal length of wall 230 of 50 mm, a longitudinal length of each horizontal engaging member of 25 mm, a longitudinal length of insulation material 256 of 100 mm, an individual wall thickness of 25 mm with a double thickness (i.e., 50 mm) for the continuous wall formed by wall 216 and wall 224, a lateral length of insulation of 50 mm, and a lateral length of the central panel of 50 mm. The overall lateral length of block 200 in this example is 200 mm. The vertical height of each portion 212, 214 is 200 mm, and the height of the vertical engaging member 234 (and the corresponding depth of vertical engaging recess 236) is 25 mm. The weight of a half-size end block 200 would be less than half of the weight of intermediate block 10 (i.e., less than 9.7 kg).

Figure 7A:
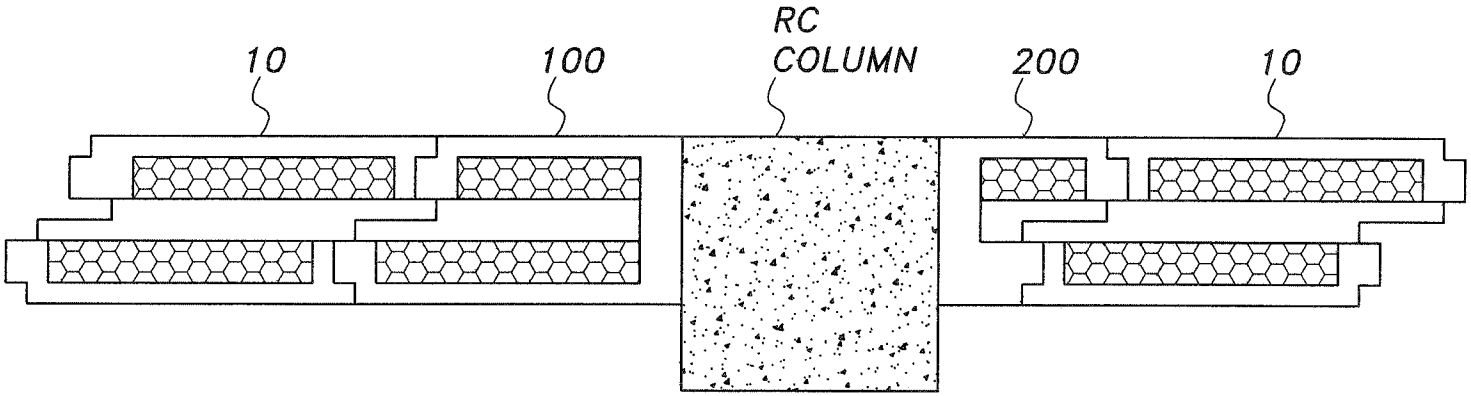
FIG. 7A is a top view of an exemplary construction configuration using a set made from the first, second and third types of interlocking and insulated construction blocks.
Figure 7B:
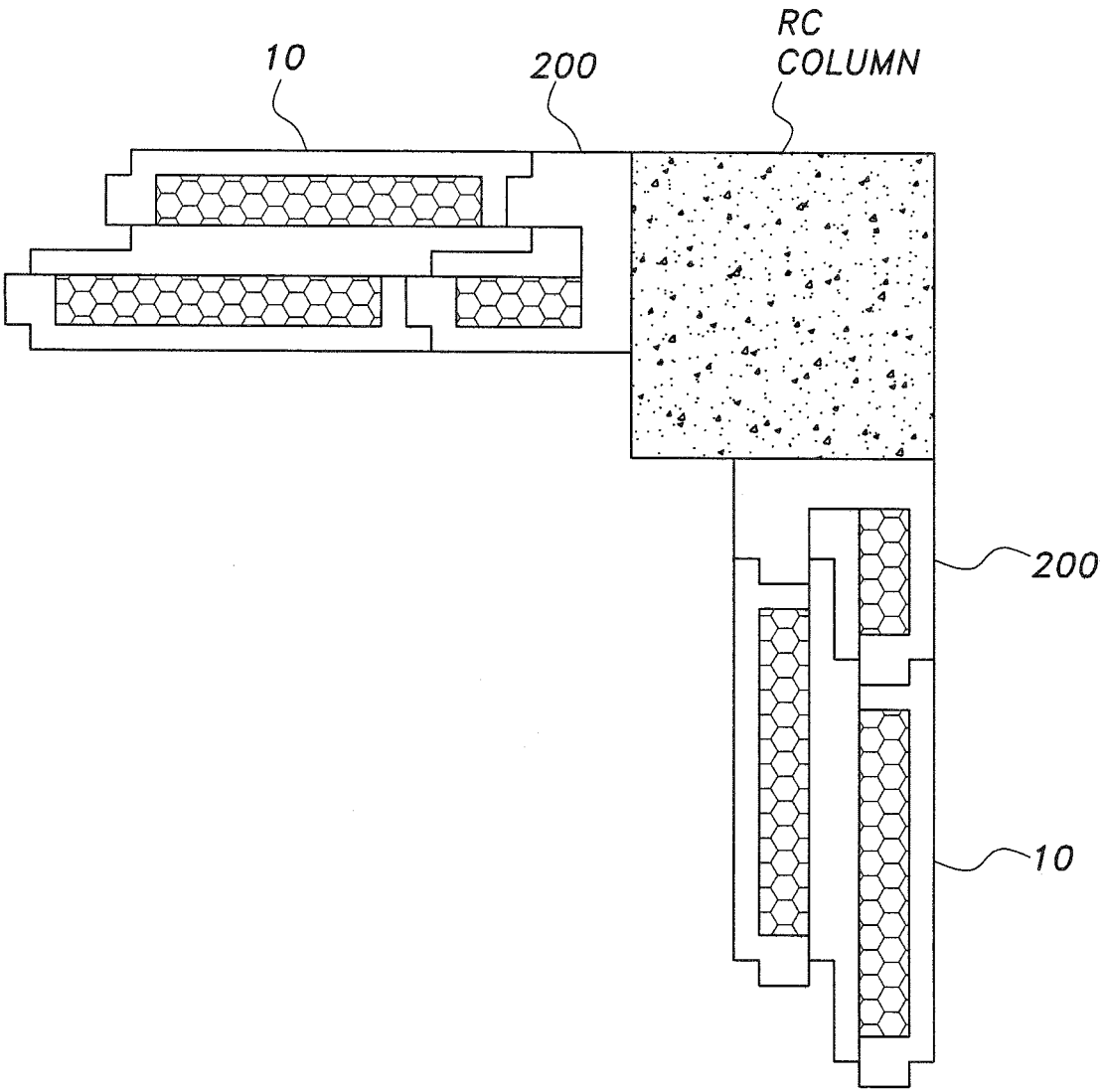
FIG. 7B is a top view of an exemplary construction configuration using a set made from the first and third types of interlocking and insulated construction blocks.
Figure 7C:
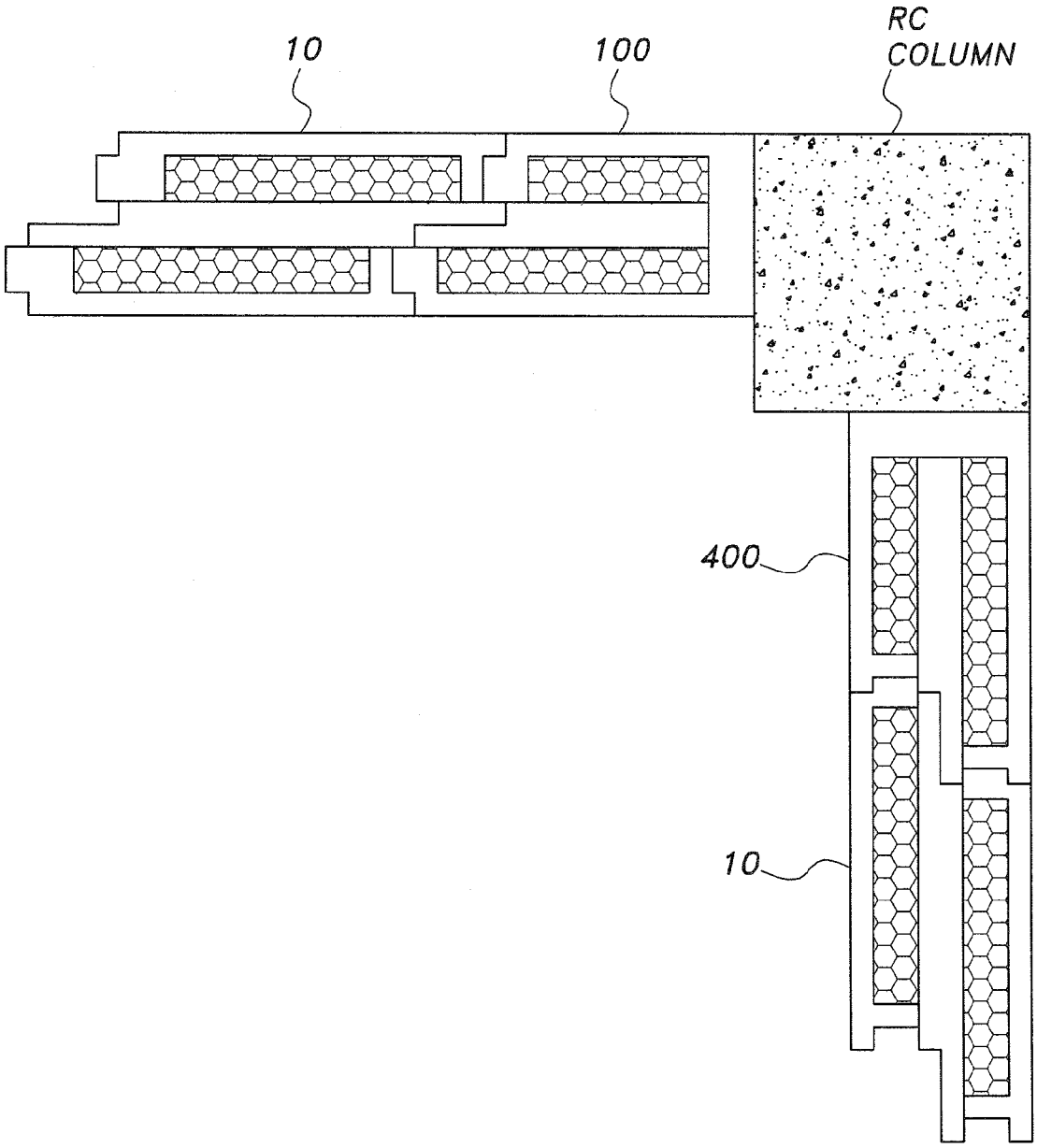
FIG. 7C is a top view of an exemplary construction configuration using a set made from the first and second types of interlocking and insulated construction blocks.

Multiple ones of each embodiment of interlocking and insulated construction block may be provided together in a set for the mortar-less, modular construction of buildings. FIG. 7A illustrates an exemplary linear construction in which the second embodiment of block 100 and the third embodiment of block 200 (i.e., each embodiment of end block) are arranged about a conventional reinforced concrete (RC) column. Intermediate blocks 10 are respectively interconnected to each of the end blocks 100, 200. FIG. 7B illustrates an exemplary corner construction utilizing two of the third embodiment of blocks 200, arranged 90° with respect to one another about a conventional RC column, with each being respectively interconnected to a corresponding intermediate block 10. FIG. 7C illustrates a further exemplary corner construction utilizing one of the second embodiments of blocks 100 arranged 90° with respect to an alternative second embodiment of block 400 (i.e., the alternative embodiment of FIG. 5) about a conventional reinforced concrete (RC) column, with each end block being respectively interconnected to a corresponding intermediate block 10.

Figure 8:
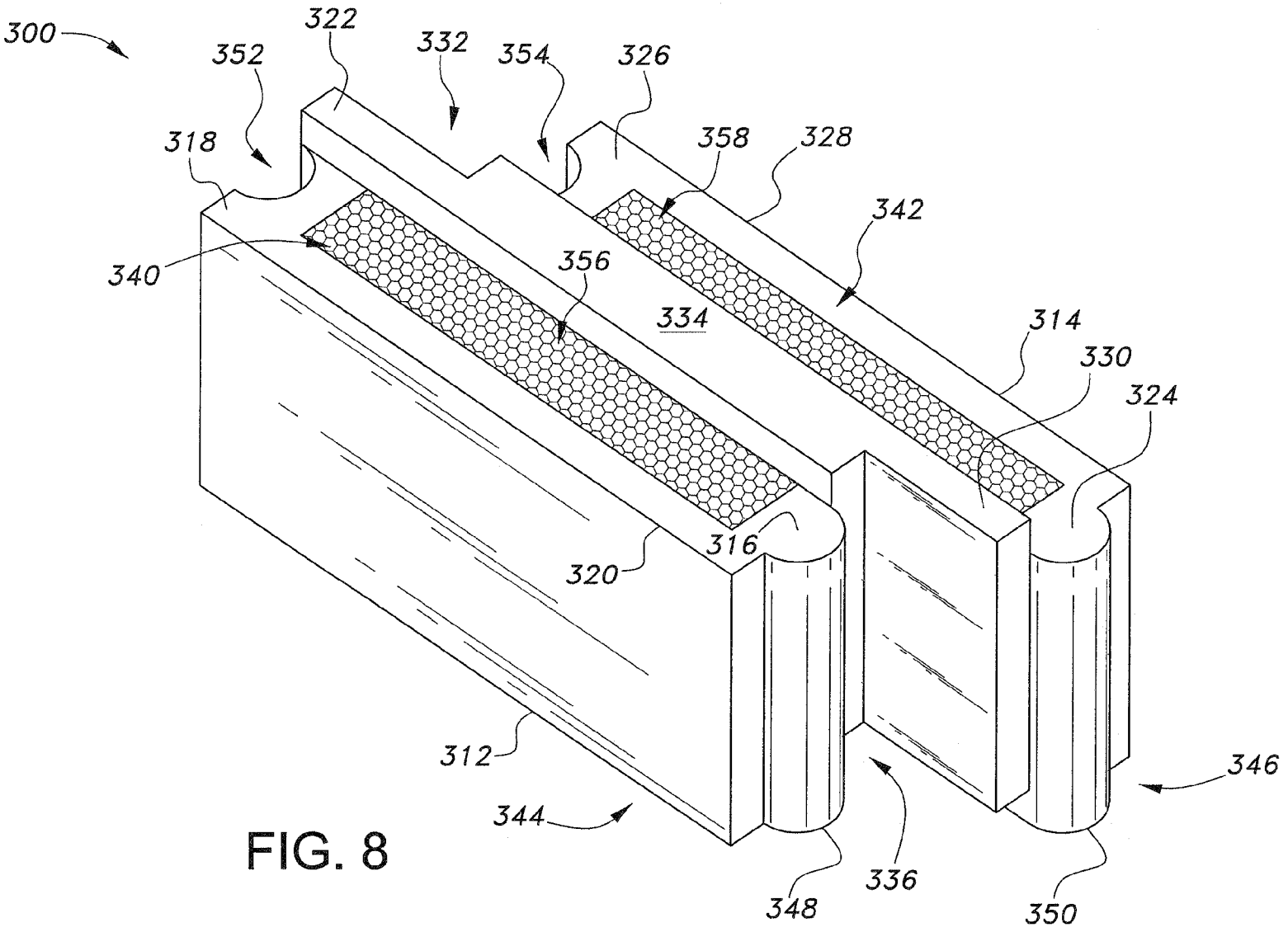
FIG. 8 is a perspective view of an alternative embodiment of the first type of interlocking and insulated construction block of FIG. 1.

In the alternative embodiment of FIG. 8, the block 300 is identical to the block 10 of FIGS. 1-3, but the horizontal engaging members 48, 50 of block 10, which each have a substantially rectangular cross-sectional contour, have been replaced by horizontal engaging members 348, 350, which each have a substantially semi-circular contour. The corresponding horizontal engaging recesses 52, 54 of block 10, which have similar rectangular cross-sectional contours, have also been replaced by horizontal engaging recesses 352, 354, which have substantially semi-circular cross-sectional contours. It should be understood that the engaging members of each embodiment of block described above, and their corresponding engaging recesses, may have any suitable type of contouring.

Briefly, interlocking and insulated construction block 300 includes first and second rectangular portions 312, 314, respectively. The first rectangular portion 312 includes a pair of longitudinally opposed walls 316, 318 and a pair of laterally opposed walls 320, 322. The first rectangular portion 312 further has an open top end 340 and an open bottom end 344. The walls 316, 318, 320, 322 of the first rectangular portion 312 define an open interior region. Similarly, the second rectangular portion 314 includes a pair of longitudinally opposed walls 324, 326 and a pair of laterally opposed walls 328, 330. The second rectangular portion 314 also has an open top end 342 and an open bottom end 346. The walls 324, 326, 328, 330 of the second rectangular portion 314 also define an open interior region. First and second volumes of thermal insulation material 356, 358 respectively fill the open interior regions of the first and second rectangular portions 312, 314.

The first and second rectangular portions 312, 314 are vertically aligned with respect to one another (i.e., the top ends 340, 342 are vertically aligned, as are the bottom ends 344, 346) and are further longitudinally staggered with respect to one another. Laterally opposed wall 322 of the first rectangular portion 312 and laterally opposed wall 330 of the second rectangular portion 314 define a central panel 332. The central panel 332 has opposed top and bottom ends, with the top end 334 being vertically raised with respect to the open top ends 340, 342 of the first and second rectangular portions 312, 314, respectively, to define a vertical engaging member. Correspondingly, the bottom end of panel 332 is vertically raised with respect to the open bottom ends 344, 346 of the first and second rectangular portions 312, 314, respectively, to define a vertical engaging recess 336.

Additionally, longitudinally opposed walls 316, 324 of the first and second rectangular portions 312, 314, respectively, define horizontal engaging members 348, 350, respectively, with longitudinally opposite horizontal engaging recesses 352, 354 being defined in the first and second rectangular portions 312, 314.

It should be understood that any of the above embodiments of the interlocking and insulating construction blocks may have horizontal engaging members (and corresponding horizontal engaging recesses) having any desired cross-sectional contour, such as, for example, the rectangular horizontal engaging members 48, 50 and horizontal engaging recesses 52, 54 of the first type of block 10, or the substantially semi-circular horizontal engaging members 348, 350 and horizontal engaging recesses 352, 354 of block 300 of FIG. 8. Additionally, it should be understood that any of the embodiments of the second and third types of blocks (i.e., the end blocks) may have either horizontal engaging members, such as horizontal engaging members 148, 150 of block 100, or may alternatively have horizontal engaging recesses, such as horizontal engaging recesses 348, 350 of block 300.

Figure 9A:
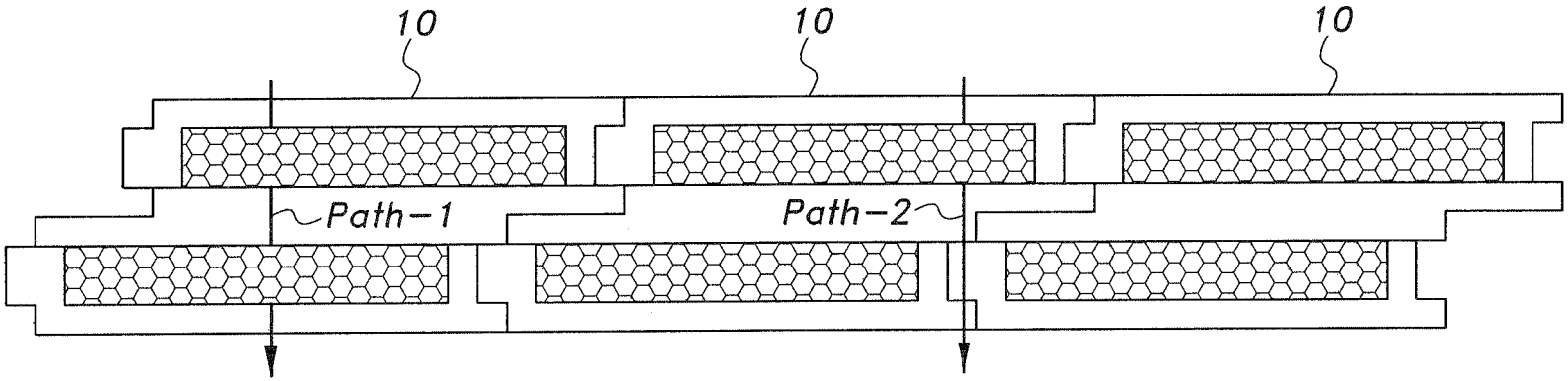
FIG. 9A diagrammatically illustrates possible heat transmission paths through interlocked ones of the first type of interlocking and insulated construction blocks.
Figure 9B:
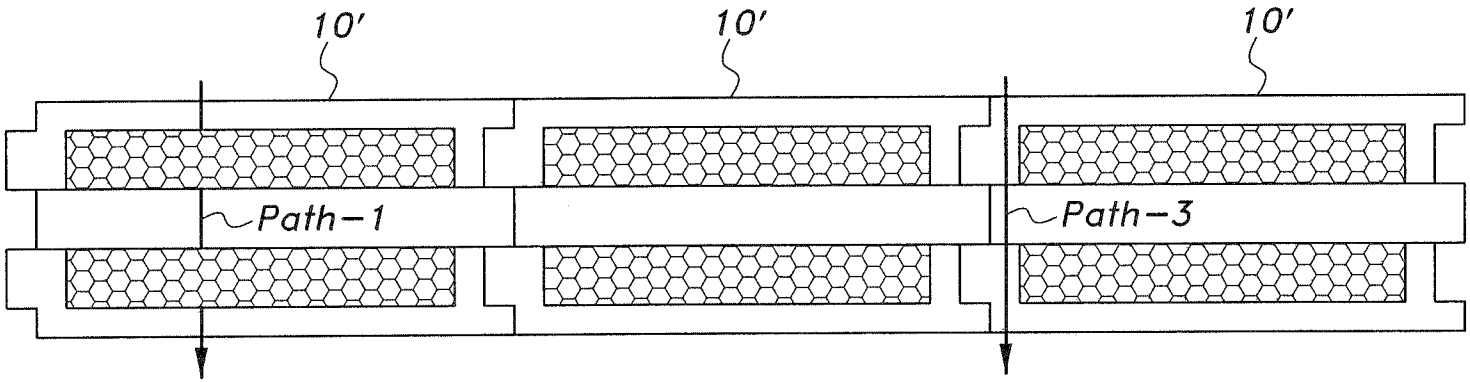
FIG. 9B diagrammatically illustrates possible heat transmission paths through interlocked insulated construction blocks with non-staggered portions for purposes of comparison against FIG. 9A.
Figure 10A:
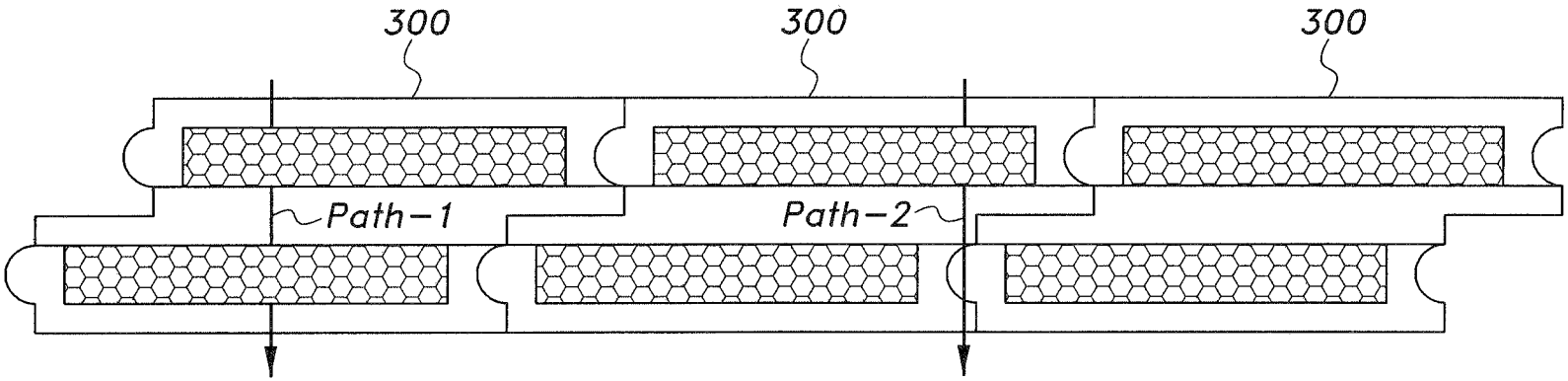
FIG. 10A diagrammatically illustrates possible heat transmission paths through interlocked ones of the interlocking and insulated construction blocks of FIG. 8.
Figure 10B:
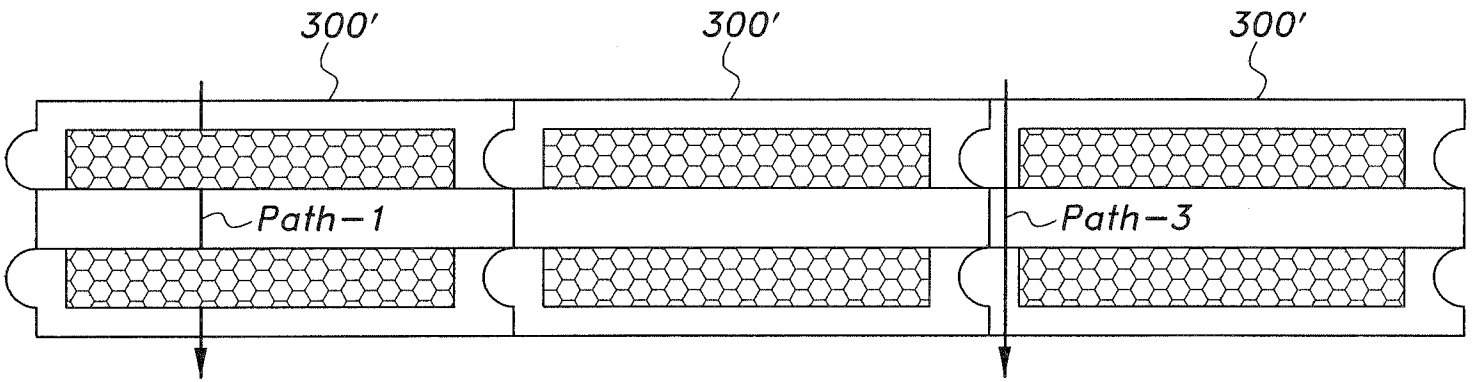
FIG. 10B diagrammatically illustrates possible heat transmission paths through construction blocks with non-staggered portions for purposes of comparison against FIG. 10A.

In order to illustrate the thermal efficiency of the staggered insulated regions of blocks 10, three interconnected blocks 10 (shown in FIG. 9A) are compared against three modeled blocks 10' (shown in FIG. 9B) which include similar first and second rectangular portions housing insulating material, but where the two rectangular portions in each block 10' are aligned; i.e., non-staggered. A similar comparison is made between three interconnected blocks 300 (shown in FIG. 10A) compared against three modeled blocks 300' (shown in FIG. 10B). Three separate paths of heat transmission (indicated as Path-1, Path-2 and Path-3 in FIGS. 9A-10B) are considered.

Table 1 below shows the calculated U-values for the differing paths of heat transmission, and Table 2 below shows the calculated U-values for differing types of construction blocks; i.e., a comparison between those of the present invention against blocks with a non-staggered configuration.

TABLE 1

U-values for Differing Paths of Heat Transmission

| Path | Wall configuration | Thickness (mm) | Thermal conductivity, k (W/mK) | Thermal resistance ($m^2K/W$) | U-value for the path ($W/m^2K$) |
|---|---|---|---|---|---|
| Path-1 (FIGS. 9A-10B) | Block material<br>Insulation | 100<br>100 | 1<br>0.033 | 3.31 | 0.30 |
| Path-2 (FIGS. 9A, 10A) | Block material<br>Insulation | 150<br>50 | 1<br>0.033 | 1.85 | 0.54 |
| Path-3 (FIGS. 9B, 10B) | Block material<br>Insulation | 200<br>0 | 1<br>— | 0.38 | 2.63 |

TABLE 2

U-values of Differing Wall Configurations

| Wall | Path | Wall length (mm) | U-value for the path ($W/m^2K$) | U-value of Wall ($W/m^2K$) |
|---|---|---|---|---|
| Non-staggered insulation cavities (FIGS. 9B, 10B) | Path-1<br>Path-3 | 325<br>75 | 0.30<br>2.63 | 0.74 |
| Staggered insulation cavities (FIGS. 9A, 10A) | Path-1<br>Path-2 | 250<br>150 | 0.30<br>0.54 | 0.39 |

In Table 2, calculations are made for one block length of wall, which is repeated in the wall configuration. Table 2 clearly shows an increase in the insulating efficiency of the staggered configuration (i.e., the intermediate blocks of the present invention) when compared against similar types of construction blocks having non-staggered cavities. The calculations are based on the following exemplary dimensions for each individual construction block: a longitudinal length of each outer, longitudinally extending wall (i.e., walls 20, 28 of FIG. 1) of 400 mm, a longitudinal length of each horizontal engaging member (and depth of each horizontal engaging recess) of 25 mm, a longitudinal length of insulation of 325 mm, an individual wall thickness of 25 mm, a lateral length of insulation of 50 mm, and a lateral length of the central panel of 50 mm. One can see in Table 2 that the staggered configuration of the present invention reduces the U-value of the external wall from 0.74 (for non-staggered) to 0.39 $W/m^2K$ (i.e., a 47% reduction).

It is to be understood that the present invention is not limited to the embodiments described above, but encompasses any and all embodiments within the scope of the following claims.

We claim:

1. An interlocking and insulated construction block set, comprising:

a first construction block, the first construction block including a first pair of opposing sides and a second pair of opposing sides extending normal to the first pair of opposing sides, at least one cavity extending through the construction block, the at least one cavity including a first volume of thermal insulation material, a first side of the first pair of opposing sides being an engageable side, the first engageable side having a first tongue and a second tongue, the first tongue and the second tongue being staggered with respect to one another;

a second construction block, the first construction block including a first pair of opposing sides and a second pair of opposing sides, the second pair of opposing sides extending normal to the first pair of opposing sides, at least one cavity extending through the construction block, the at least one cavity including a first volume of thermal insulation material, a first side of the first pair of opposing sides being an engageable side, the first engageable side having a first groove and a second groove, the first groove and the second groove being staggered with respect to one another and configured to cooperate with the first and second tongues of the first construction block for locking the first engageable side of the first block with the first engageable side of the second block, further wherein the first construction block and the second construction block each include a central panel extending parallel to the second pair of opposing sides, the central panel having opposed top and bottom ends, the top end thereof being vertically raised with respect to top ends of said second pair of opposing sides to define a third tongue, the bottom end thereof being vertically raised with respect to bottom ends of the second pair of opposing sides to define a groove, a second side of the first pair of opposing sides of the first construction block is an engageable side, the second engageable side having a first groove and a second groove, the first groove and the second groove being staggered with respect to one another, and a second side of the first pair of opposing sides of the second construction block is an engageable side, the second engageable side having a first tongue and a second tongue, the first tongue and the second tongue being staggered with respect to one another; and a first volume of thermal insulation material filling the at least one cavity.

2. The interlocking and insulated construction block set as recited in claim 1, wherein the first volume of thermal insulation material is selected from the group consisting of expanded polystyrene, mineral wool, polyurethane foam, urethane foam, phenolic foam, cellulose, glass wool, rock wool, vermiculite, perlite, plant fibers and combinations thereof.

3. The interlocking and insulated construction block set as recited in claim 1, wherein:

the at least one cavity of the first construction block and the second construction block includes a first cavity and a second cavity, the first cavity and the second cavity being staggered with respect to each other and separated by the central panel, and each of the first and second cavities include a volume of thermal insulation material selected from the group consisting of expanded polystyrene, mineral wool, polyurethane foam, urethane foam, phenolic foam, cellulose, glass wool, rock wool, vermiculite, perlite, plant fibers and combinations thereof.

4. An interlocking and insulated construction block, comprising:

a) a first rectangular portion, the first rectangular portion includes a pair of longitudinally opposed sidewalls and a pair of laterally opposed walls, the laterally opposed sidewalls defining an inner wall and an outer wall, the first rectangular portion further having an open top end and an open bottom end, wherein the walls collectively define an open interior region therebetween;

b) a second rectangular portion, the second rectangular portion includes a pair of longitudinally opposed sidewalls and a pair of laterally opposed walls, the laterally opposed sidewalls defining an inner wall and an outer wall, the second rectangular portion having an open top end and an open bottom end, wherein the walls of the second rectangular portion define an open interior region therebetween;

c) the first and second rectangular portions are vertically aligned with respect to one another and are further longitudinally staggered with respect to one another;

d) the inner laterally opposed wall of the first rectangular portion and the inner laterally opposed wall of the second rectangular portion collectively define a central panel;

e) the central panel having opposed top and bottom ends, respectively, with the top end being vertically raised with respect to the open top ends of the first and second rectangular portions, respectively, to define a vertical tongue engaging member;

f) the bottom end of panel being vertically raised with respect to the open bottom ends of the first and second rectangular portions, respectively, to define a vertical groove;

g) the longitudinally opposed sidewalls of the first and second rectangular portions, respectively, defining horizontally staggered tongues, respectively, with horizontally staggered grooves being defined in the first and second rectangular portions; and h) a first volume of thermal insulation material filling the open interior region of each of the first and second rectangular portions, whereby the interlocking and insulated construction block may be interconnected to another construction block by first horizontally aligning the blocks, and then locking the horizontally staggered tongues of one of the blocks into the corresponding horizontally staggered grooves of the other block, further whereby two of the blocks may be vertically interconnected by first vertically aligning the blocks and then vertically locking the vertical engaging tongue member of one of the blocks into the corresponding vertical engaging groove of the other block.

* * * * *